United States Patent [19]

Gallatin et al.

[11] Patent Number: 4,516,005

[45] Date of Patent: May 7, 1985

[54] SEQUENCED INTERMITTENT BLOWOUT COIL CONTROLLER

[75] Inventors: Paul M. Gallatin, Picayune, Miss.; Henry J. Dyken; Norbert F. Cvengros, both of Slidell, La.

[73] Assignee: Siemens-Allis, Inc., Atlanta, Ga.

[21] Appl. No.: 537,708

[22] Filed: Sep. 30, 1983

[51] Int. Cl.[3] ..... H01H 9/44

[52] U.S. Cl. ..... 200/147 R; 335/201

[58] Field of Search ..... 361/9, 12, 14; 200/147 R; 335/201

[56] References Cited

U.S. PATENT DOCUMENTS 1,816,894 8/1931 Burnham ..... 200/147 R
1,863,312 6/1932 Mason ..... 200/147 R
2,643,314 6/1953 Ridgley ..... 200/147 R X
2,815,418 12/1957 Latour ..... 200/147 R

*Primary Examiner*—Harry E. Moose, Jr.
*Attorney, Agent, or Firm*—F. W. Powers; J. L. James

[57] ABSTRACT

A contactor having main and auxiliary contacts and an arc quenching system including a blowout coil. The blowout coil is connected in series with a first and second set of auxiliary contacts and the resulting series combination connected in shunt around the main contacts. The second set of auxiliary contacts is arranged to open after the first auxiliary closes and before the main contacts close in order to remove the blowout coil from the circuit when the main contacts are carrying load current.

11 Claims, 3 Drawing Figures

SEQUENCED INTERMITTENT BLOWOUT COIL CONTROLLER

BACKGROUND OF THE INVENTION

The present invention relates to contactors, and more particularly to improved means for controlling the operation of the arc-quenching circuit of a contactor.

Contactors are a type of electrical switching device which is adapted to make and break relatively high currents over and over again, often sustaining arcing, heat and wear. Unlike circuit breakers, which are also adapted to break high currents, contactors ordinarily need only be able to interrupt normal-level load current. Unlike circuit breakers, however, a contactor must be able to operate repeatedly in normal service without periodic inspection or replacement of parts. Further, unlike a circuit breaker, a contactor must be able to close an energized circuit, sustaining full load current each time. Since the device is always in the circuit it must present as small an impedance as possible in order to avoid losses and undesirable heating.

Normally contactors are provided with arc chutes and associated electromagnetic field for urging an arc upward into the chute, where it is stretched, cooled and extinguished. Magnetomotive force is provided by a coil, termed a "blowout coil", which is ordinarily in series with an auxiliary contact. When the contactor opens, the auxiliary contact initially stays closed and carries load current so that the main contacts may separate with little or no arcing. The auxiliary contacts then open, drawing an arc between them. The current flowing through the auxiliary contacts, however, is also flowing through the blowout coil and thus produces a magnetic field which urges the arc away from the auxiliary contacts and eventually extinguishes it. When the main contacts again close, the auxiliary contacts also close so that the blowout coil is connected in parallel about the main contacts. Due to the resistance inherent in the coil (and to some extent in the auxiliary contacts) practically all of the load current flows through the main contacts.

After many operations, however, the main contacts may become contaminated or dirty due to the environment in which the contactor is used. This dirt and contamination then raises the effective resistance of the main contacts to the point where significant amounts of load current begin to be diverted through the blowout coil circuit. The result is to give rise to $I^2R$ heating in the coil, ultimately causing it to fail because of destroyed insulation or even melted conductor material. Accordingly, it will be appreciated that it would be highly desirable to provide a control system for a contactor which precludes the shunting of load current through a blowout coil due to heightened resistance of main contacts.

It is therefore an object of the invention to provide an improved contact sequencing system.

Another object is to effect the disconnection of a blowout coil during closure of a set of contactor main contacts.

Yet another object is to provide a contactor with a simple, reliable mechanism for operating multiple contacts in the necessary sequence for disconnecting a blowout coil when its presence is unnecessary to the operation of the system.

SUMMARY OF THE INVENTION

Briefly stated, in accordance with one aspect of the invention the foregoing objects are achieved by providing a contactor having main contacts and a blowout coil with a set of auxiliary contacts. The auxiliary contacts are coupled in series with the blowout coil and this combination connected across the main contacts. Means are provided to open-circuit the combination after the main contacts close so that there remains no shunt path across them.

In a presently-preferred embodiment a second set of auxiliary contacts is used to open-circuit the shunting combination. The auxiliary contacts are preferably mounted on an arm carrying the movable main contact and arranged so that a first set of auxiliary contacts closes before, and opens after, the main contacts and a second set of auxiliary contacts opens after the first auxiliary contacts close but before the main contacts close to isolate the blowout coil from the load circuit.

BRIEF DESCRIPTION OF THE DRAWINGS

While the specification concludes with claims particularly pointing out and distinctly claiming the subject matter which is regarded as the invention, it is believed that the invention will be better understood from the following description of a preferred embodiment taken in conjunction with the accompanying drawings in which:

DESCRIPTION OF A PREFERRED EMBODIMENT

Figure 1:
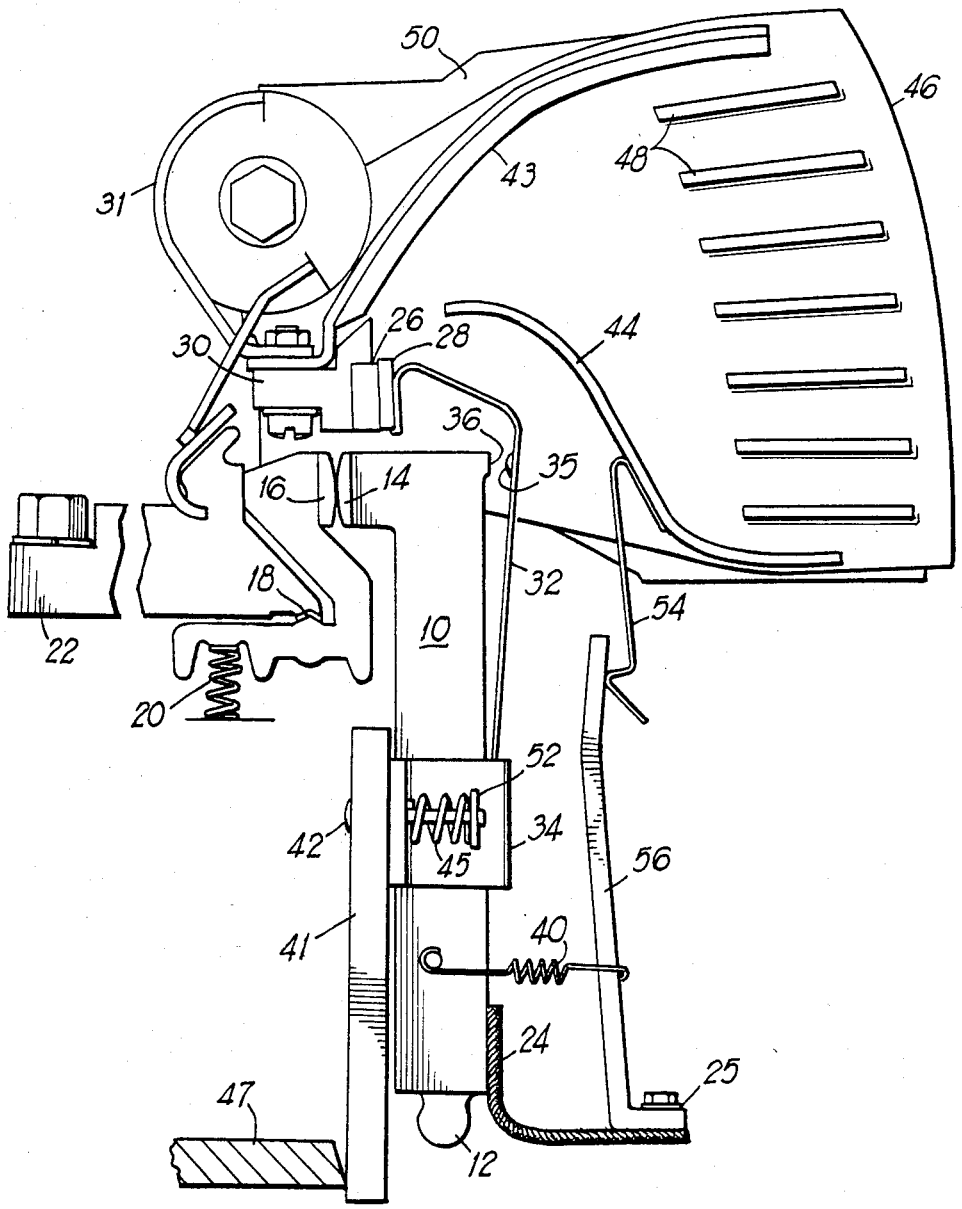
FIG. 1 represents the operating mechanism of a contactor incorporating principles of the present invention in its fully closed position.

Referring now to FIG. 1, the principal operating elements of a contactor are shown. For purposes of clarity in illustration the outer casing of the device is not represented, nor are some other standard elements of the device. Those skilled in the art will readily perceive the requirement for such standard elements and understand the normal practices utilized in enclosing the elements shown in appropriate housings and coupling them to cables, bus bars or the like for connecting the contactor in a load circuit. Certain conventional items are depicted, however, in the interest of providing a complete description of the operation of the mechanism.

As is conventional a pair of main contacts, one fixed and the other movable, is provided for carrying load current. The movable contact-carrying arm 10 is pivoted on a cylindrical end portion 12 which seats in an appropriate socket in the frame of the contactor. The movable one of the main contacts 14 is carried by the arm 10 and abuts the stationary main contact 16. It will be understood by those skilled in the art that contact 16, while it is conventionally termed "fixed" or "stationary" in fact is allowed a limited movement by way of a pivoted mounting point 18 to afford the desired wiping action which avoids welding, and counteracts contamination of the contacts. A spring 20 biases the contact 16 to a position slightly ahead of that depicted to allow the necessary movement to occur. Since contact 16 does not move in such a way to make or break contact, however, it is properly thought of as the fixed one of the pair of contacts.

Contact 16 is electrically connected to a terminal 22 which in turn is adapted to receive a cable, bus bar or other electrical conductor for carrying load current to or from the contactor. From an electrical point of view the terminal and contact 16 may be regarded as one element, and it is contemplated that numerous other such constructions may be utilized with the present invention. In the same manner a flexible lead 24 is shown fastened to movable arm 10 for conducting current to or from the second terminal 25. Many other arrangements may be utilized for this purpose and it will be readily understood that the specific designs of such conventional details may be varied without departing from the scope of the invention.

A first set of auxiliary contacts 26 and 28 is provided, contact 26 being fixed to a support 30. A conventional blowout coil 31 is connected between terminal 22 and support 30 so that a continuous circuit is formed between the terminal (and thus the fixed main contact 16) and the fixed auxiliary contact 26. The movable contact 28 of the first set of auxiliary contacts is carried by a second arm constituting movable auxiliary contact support 32. The auxiliary contact support takes the form of an elongate, flexible arm which is mounted on and moves with first arm 10. Second arm 32 is mounted on arm 10 by means of carrier 34. The lower end of arm 32 is enclosed in insulating material such as silicone glass tape which electrically insulates it from arm 10 and carrier 34.

Near the upper end of arm 32 is affixed a contact 35, which is therby electrically coupled to the movable one 28 of the first pair of auxiliary contacts. Another contact 36 is provided on arm 10 directly opposite contact 35 for engaging the latter. Contacts 35 and 36 form a second pair of auxiliary contacts and effectively comprise a switch for disconnecting the shunting circuit around the main contacts formed by blowout coil 31 and first auxiliary contacts 26 and 28. In a presently preferred embodiment contact 36 is attached directly to and formed integrally with arm 10 so that it is electrically connected to movable main contact 14 through the material of arm 10.

In the preferred embodiment shown, the contactor is of the normally-open type. A return spring, shown here as a coil spring 40, biases the arm 10 to its open position. An electromagnetic actuator of any appropriate type is coupled to arm 10 for urging the arm to the left and closing the main contacts when the actuator is energized. In the embodiment shown an armature 41 is coupled to carrier 34, and thus to arm 10, by means of a pin 42 and spring 45. A keeper 52 secures the spring on pin 42 to hold the carrier and armature tightly together. The presence of the spring, however, accommodates the misalignment occurring between arm 10 and armature 41 because of their different pivot points. As there are a wide variety of actuators, armatures and connecting linkages in use it is considered well within the skill of those familiar with the art to select an appropriate actuator and linkage for a given application.

Extending above and at either side of the first set of auxiliary contacts are a pair of arc horns or runners 43 and 44. As is conventional runner 43 is electrically connected to stationary contact 26, while runner 44 is positioned near the location of movable contact 28 in its open position. About the ends of the runners is a conventional arc chute generally indicated at 46 and containing a set of baffles 48 which interfere with and elongate the arc when it has been moved upwardly into the chute.

A pair of pole plates, one of which is indicated at 50 extend at either side of the arc chute in the usual manner to produce a magnetic field across the arc chute for urging the arc upwardly into the chute for extinguishment. The pole shoes also extend to the ends of the core lying within blowout coil 3, from which the necessary magnetomotive force is produced. Runner 44 is supported by clip 54 and bar 56, which are coupled to terminal 25.

In operation consider first that the main contacts have been closed and the contactor is conducting current in the normal fashion. Current from a power source traverses a cable, bus bar or the like and flows through terminal 22 and thence to stationary contact 16. The current then flows through the movable main contact 14, through arm 10, flexible lead 24 and out terminal 25 to be applied to a load. Unlike conventional devices no current flows through the blowout coil since the coil is open-circuited. Although the first set of auxiliary contacts 26, 28 are closed the second set 35,36 is open. Inasmuch as the conductive second arm 32 is insulated from arm 10 no circuit is formed and current can flow only through the main contacts.

Figure 2:
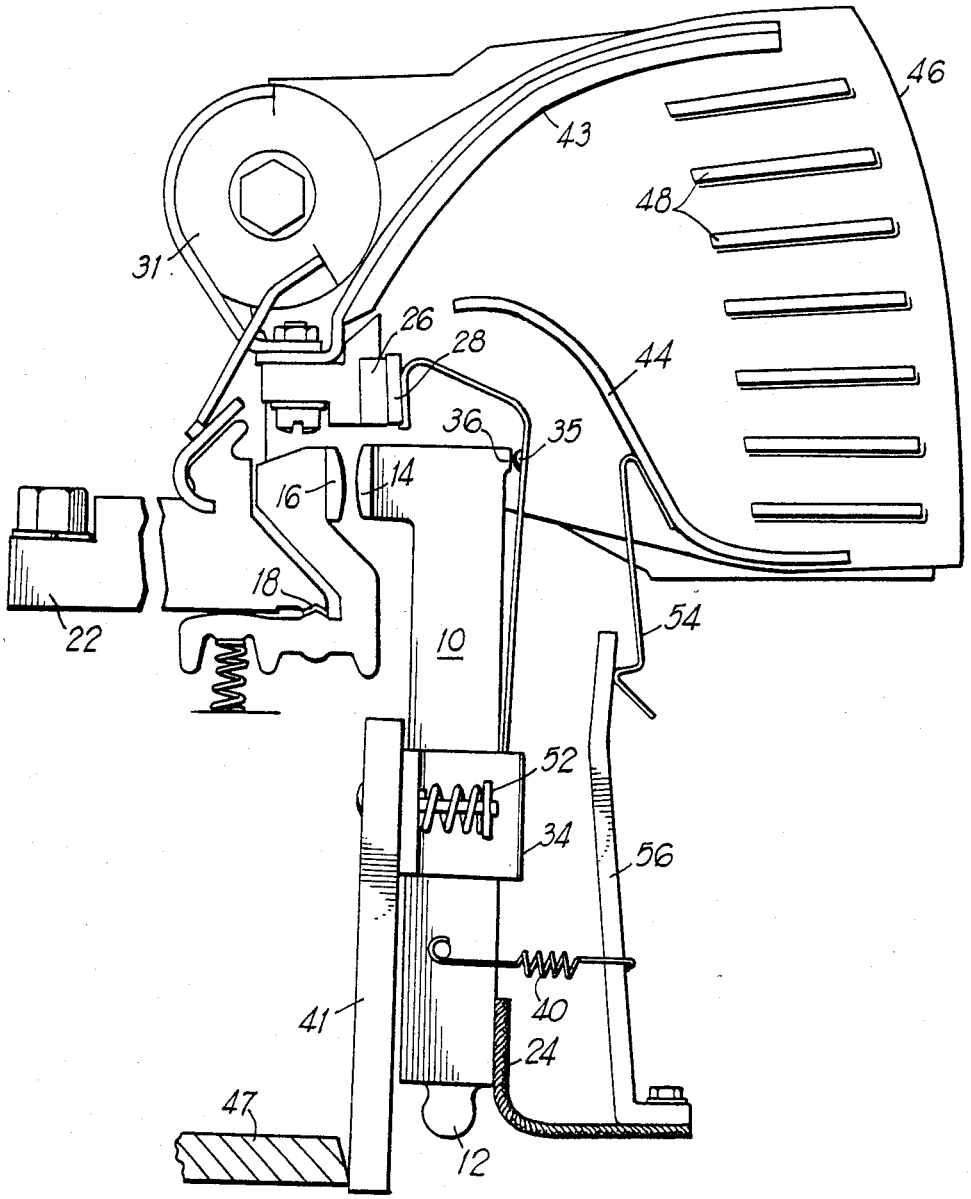
FIG. 2 illustrates the mechanism of FIG. 1 just after the main contacts have begun to open.

Referring now to FIG. 2, in order to break the load circuit the actuator is deenergized and arm 10 is allowed to be pulled to the right by spring 40. This initially causes main contacts 14 and 16 to separate, drawing an arc between them. Shortly thereafter arm 10 makes contact with arm 32 or, more precisely contact 35 so that the second set of auxiliary contacts 35 and 36 are closed. In this manner a circuit is completed through terminal 22, blowout coil 3, first auxiliary contacts 26, 28 and the second set of auxiliary contacts 35 and 36. Current now transfers from the main contacts to the blowout coil since it presents a relatively low impedance path as compared with the arcing path between the main contacts.

Figure 3:
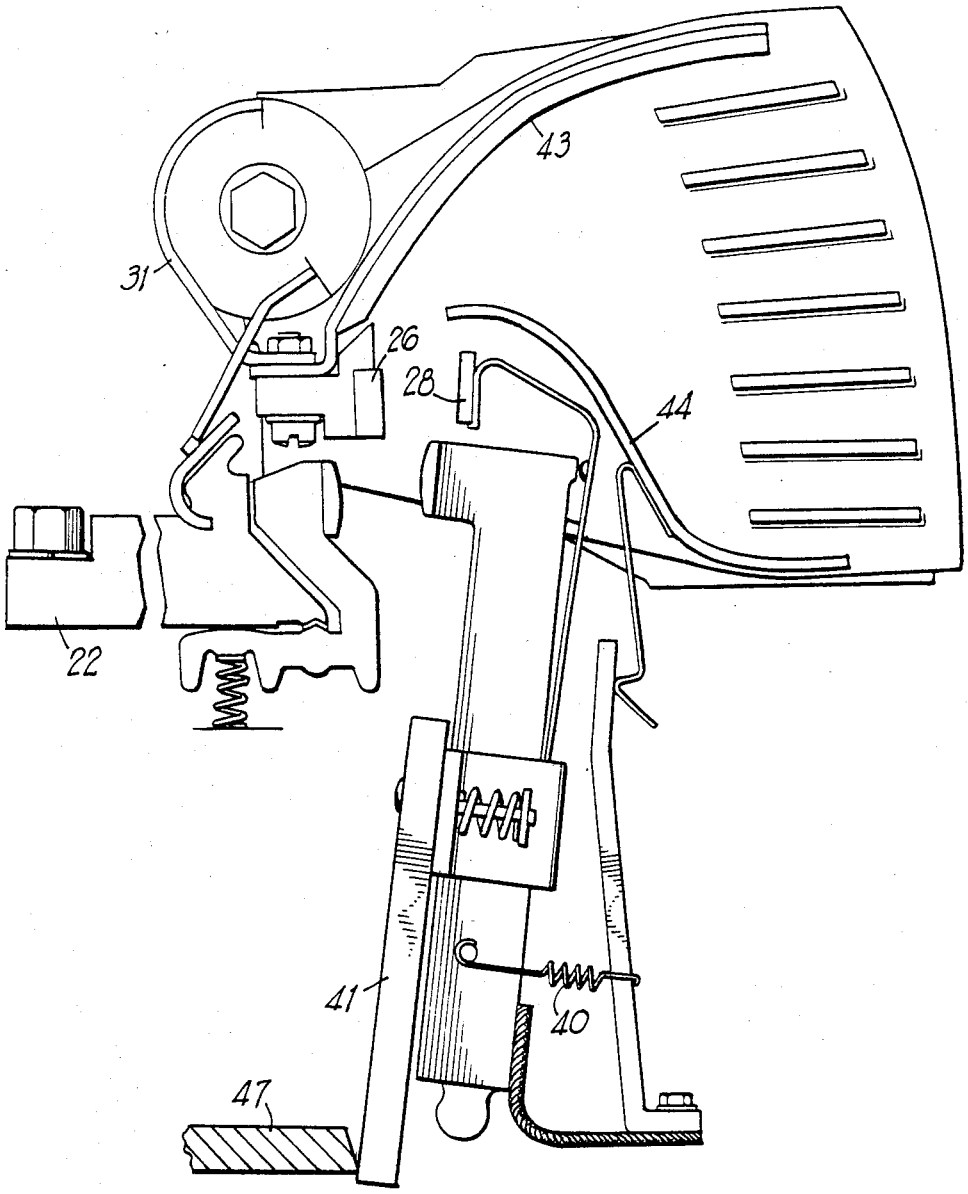
FIG. 3 illustrates the mechanism in its fully open position.

FIG. 3 shows the position of the elements when a full open position has been achieved. As the arm 10 moves to its furthest open position it continues to maintain the second set of auxiliary contacts closed. As arm 10 has moved to a full open position, however it has simultaneously pushed arm 32 back also and in so doing has opened the first set of auxiliary contacts 26 and 28. Now the arc originally drawn between the main contacts is transferred to the first set of auxiliary contacts. From there the transverse magnetic field set up by the blowout coil and the pole plates urges the arc further upwardly whereupon it transfers to the arc runners and extends along runners 43 and 44. The arc continues along the runners and into the arc chute in the usual manner until it is quenched and ultimately extinguished.

Closing of the contactor is the reverse of the mechanical sequence just described. The actuator pulls the arm 10 to the left, initially causing the first set of auxiliary contacts to close. Current begins to flow momentarily; as the main contacts continue to close the second set of auxiliary contacts open and a small arc is drawn between them. The main contacts then close and full current immediately flows through them, discontinuing the current flow through the blowout coil and the first set of auxiliary contacts, and extinguishes the small arc at the second set of auxiliary contacts.

In prior art contactors in which the blowout coil remains in circuit about the main contacts it was usually assumed that no current would flow through the coil since its small but finite resistance would cause practically all current to go through the main contacts. However, in some circumstances it has been found that dirt and other contaminants accumulate on the surfaces of the main contacts. As a result the resistance of the contacts increases to the point where eventually a very substantial current flows through the blowout coil. Since the coil conductors are not sufficiently large to withstand the full load current for any substantial time they soon overheat and the blowout coil fails. With the blowout coil failed, and full current flow reverts to the main contacts. Thus, when an attempt is made to operate the contactor there will be no magnetic field to force the arc into the arc chute and the arc will destroy the contactor. The present invention precludes this by positively opening the blowout coil circuit with a mechanism integrated with the main contact apparatus, whereby closure of the main contacts positively opens the blowout coil circuit.

As will be evident from the foregoing description, certain aspects of the invention are not limited to the particular details of the examples illustrated, and it is therefore contemplated that other modifications of applications will occur to those skilled in the art. Equivalent means of opening the short circuit may be implemented, such as reopening the first auxiliary contacts or replacing the second auxiliary contacts with other switching means. It is accordingly intended that the appended claims shall cover all such modifications and applications as to not depart from the true spirit and scope of the invention.

What is claimed as new and desired to be secured by Letters Patent of the United States is:

1. In a circuit switch of the contactor type adapted to open and close a circuit carrying sufficient current to cause arcing to occur when the circuit is opened and having an arc chute for extinguishing the arc and magnetic pole plates for urging the arc into the arc chute, a pair of main contact set comprising a fixed and a movable contact for carrying load current;

a pair of auxiliary contacts;

connecting means for coupling said auxiliary contacts in parallel with said main contacts to form a shunt circuit about said main contacts;

means for opening and closing said main contacts;

means for causing said first pair of auxiliary contacts to open after, and to close before, said main contacts open and close, respectively, and means for opening said shunt circuit subsequent to the closing of said main contacts.

2. The invention defined in claim 1, wherein said connecting means comprises a blowout coil for producing magnetic flux in the pole plates in response to current flow through said auxiliary contacts.

3. The invention defined in claim 2, wherein said means for opening said shunt circuit comprises switching means coupled in circuit with said connecting means.

4. The invention defined in claim 3, wherein said auxiliary contacts comprise a first, fixed contact and a second, movable contact; and wherein said blowout coil is coupled to said first, fixed auxiliary contact.

5. The invention defined in claim 4, wherein said switching means are coupled to said second, movable auxiliary contact.

6. The invention defined in claim 5, wherein said switching means comprises a second pair of auxiliary contacts.

7. The invention defined in claim 6, wherein one of said second auxiliary contacts is carried by said movable main contact.

8. The invention defined in claim 7, wherein the movable ones of said auxiliary contacts are carried on a common support means.

9. The invention defined in claim 8, wherein said common support means is carried by said movable main contact.

10. In a contactor to open and close a circuit carrying sufficient current to cause arcing to occur when the circuit is opened and having an arc chute for extinguishing the arc and magnetic pole plates throughout for urging the arc into the arc chute, a pair of main contacts comprising a fixed contact and a movable contact;

a first pivoted arm carrying said movable main contact;

a first pair of auxiliary contacts comprising a fixed and a movable contact;

a blowout coil coupled in circuit between said fixed main and the first auxiliary contacts for producing a magnetic field in the pole plates;

a second pair of auxiliary contacts comprising a fixed and a movable contact, said fixed contact being carried by said first arm;

a second movable arm carrying the movable contacts of said first and second sets of auxiliary contacts in spaced relation thereon, said second arm being disposed in spaced relation adjacent said first arm so that said second auxiliary contacts engage when said first arm moves in a direction to open said main contacts and to close said first auxiliary contacts when said first arm moves to close said main contacts.

11. The invention according to claim 10, wherein said second arm is carried by said first arm and is electrically insulated therefrom.

* * * * *